US012345501B2

(12) United States Patent
Chiang

(10) Patent No.: US 12,345,501 B2
(45) Date of Patent: Jul. 1, 2025

(54) EXPANDABLE BATON

(71) Applicant: Kuei-Chih Chiang, Taichung (TW)

(72) Inventor: Kuei-Chih Chiang, Taichung (TW)

( * ) Notice: Subject to any disclaimer, the term of this patent is extended or adjusted under 35 U.S.C. 154(b) by 730 days.

(21) Appl. No.: 17/725,699

(22) Filed: Apr. 21, 2022

(65) Prior Publication Data

US 2022/0244012 A1 Aug. 4, 2022

Related U.S. Application Data

(63) Continuation-in-part of application No. 17/154,046, filed on Jan. 21, 2021, now abandoned.

(51) Int. Cl.
*F41B 15/02* (2006.01)

(52) U.S. Cl.
CPC ..... *F41B 15/027* (2013.01)

(58) Field of Classification Search
CPC ..... F41B 15/027
USPC ..... 463/47.7
See application file for complete search history.

(56) References Cited

U.S. PATENT DOCUMENTS 5,868,621 A * 2/1999 Parsons ..... F41B 15/025 463/47.7
6,056,643 A * 5/2000 Wilmoth, III ..... F41B 15/025 463/47.7
6,182,539 B1 2/2001 Webster
6,231,447 B1 * 5/2001 Pelkey ..... F41B 15/027 403/368
6,238,292 B1 * 5/2001 Pelkey ..... F41B 15/027 403/368
7,416,490 B2 * 8/2008 Parsons ..... F41B 15/027 463/47.7
7,491,126 B2 * 2/2009 Jung ..... F41B 15/025 463/47.7
8,956,235 B2 * 2/2015 Cheng ..... F41B 15/027 463/47.7
9,677,843 B2 * 6/2017 Parsons ..... F41B 15/027
9,833,049 B1 * 12/2017 Winters ..... A45B 9/04
10,928,158 B2 * 2/2021 Kupa ..... F41B 15/027
11,067,359 B1 7/2021 Chiang
11,236,966 B2 * 2/2022 Liang ..... F41B 15/027
11,243,046 B2 * 2/2022 Chen ..... F16B 7/105
11,585,630 B2 * 2/2023 Parsons ..... F41B 15/027
2007/0072684 A1 * 3/2007 Parsons ..... F41B 15/025 463/47.7
2013/0150167 A1 6/2013 Pelkey
2014/0194212 A1 7/2014 Walter et al.
2014/0256452 A1 9/2014 Cheng
2015/0038240 A1 2/2015 Parsons
(Continued)

*Primary Examiner* — Michael C Grant

(57) ABSTRACT

An expandable baton includes an internally threaded first tube; a first inner support tube disposed in the first tube and including first external threads secured to the internal threads of the first tube; a second inner support tube spaced from the first inner support tube with a first annular groove formed between them; a second lock mechanism at a first end of the second tube; a first lock mechanism at a first end of the first tube; a release mechanism including an axially moveable lock needle having a pointed second end, a pushbutton and a spring, a pressing of the pushbutton moves the lock needle to either insert into or disengage from the second lock mechanism, thereby unlocking the second lock protuberances or locking same; and a positioning member for limiting the release mechanism.

6 Claims, 8 Drawing Sheets

(56) References Cited

U.S. PATENT DOCUMENTS

| | | | | |
|---|---|---|---|---|
| 2016/0169616 | A1* | 6/2016 | Cheng | F41B 15/00 463/47.7 |
| 2018/0274880 | A1* | 9/2018 | Tanzini | F41B 15/022 |
| 2020/0158462 | A1 | 5/2020 | Kupa et al. | |
| 2021/0199402 | A1 | 7/2021 | Parsons et al. | |
| 2021/0310764 | A1* | 10/2021 | Hultman | F41B 15/027 |
| 2024/0191967 | A1* | 6/2024 | Hultman | F41B 15/027 |

* cited by examiner

EXPANDABLE BATON

CROSS-REFERENCE TO RELATED APPLICATION

The present application is a continuation in part of U.S. patent application Ser. No. 17/154,046, filed on Jan. 21, 2021, titled expandable baton, listing Kuei-Chih Chiang as inventor.

BACKGROUND OF THE INVENTION

1. Field of the Invention

The invention relates to expandable baton and more particularly to an expandable baton having replaceable inner support tubes.

2. Description of Related Art

Expandable batons are widely used by law enforcement personnel or as a personal protection means. A conventional expandable baton comprises a plurality of telescopic tubes is shown in FIGS. 9 and 10. The baton is expandable between an extended position and a retracted position (see FIGS. 9 and 10). As shown, a smaller tube 60 is partially retracted into a larger tube 62. At the extended position, the smaller tube 60 extends out of an end of the larger tube 62 and is locked. As an end, the baton is expanded.

However, an annular groove 64 is required to form on an inner surface of the larger tube 62 for locking the smaller tube 60 in the larger tube 62 and the larger tube 62 is required to have an increased wall thickness for the forming of the annular groove 64. Thus, a sufficient space is provided for the forming of the annular groove 64. Unfortunately, the greater wall thickness of the larger tube 62 can greatly increase its weight and make manufacturing more difficult. Further, a frequent retraction and extension of the smaller tube 60 relative to the larger tube 62 can greatly, quickly wear the inner surface of the larger tube 62. The smaller tube 60 cannot be stably disposed in the worn larger tube 62.

Thus, the need for improvement still exists.

SUMMARY OF THE INVENTION

It is therefore one object of the invention to provide an expandable baton comprising a first tube including internal threads on an inner surface of a second end; a first inner support tube having a diameter less than that of the first tube, the first inner support tube including first external threads on an outer surface, the first external threads being secured to the internal threads of the first tube; a second inner support tube having a diameter less than that of the first tube, the second inner support tube including second external threads on an outer surface, the second external threads being secured to the internal threads of the first tube, the second inner support tube spaced from the first inner support tube with a first annular groove formed between them; a second tube having a diameter less than an inner diameter of the second inner support tube; a second lock mechanism disposed at one end of the second tube and including two second lock protuberances, two second elastic members and a second externally threaded connection wherein the second externally threaded connection includes a second shoulder adjacent to the second lock protuberances, an inner diameter of the second inner support tube is less than an outer diameter of the second shoulder, the outer diameter of the second shoulder is less than an inner diameter of the first inner support tube, the second externally threaded connection is disposed in a first end of the second tube and the second shoulder urges against the first end of the second tube, a distance between each of the second lock protuberances and the second shoulder is equal to a length of the first annular groove, the second lock mechanism is moveably secured to the first annular groove, and the second tube is moveably disposed in the first tube; a first lock mechanism at the first end of the first tube, the first lock mechanism including two first lock protuberances, two first elastic members and a first externally threaded connection, the first externally threaded connection including a first shoulder adjacent to the first lock protuberances, the first externally threaded connection being disposed in the first end of the first tube and the first shoulder urges against the first end of the first tube, and the first tube being moveably disposed in a third tube; and a second annular groove formed on an inner surface of the third tube wherein a distance between each of the first lock protuberances and the first shoulder is equal to a length of the second annular groove, and the first lock mechanism is moveably secured to the second annular groove; a release mechanism including an axially moveable lock needle having a pointed second end a housing at a first end, a pushbutton correspondently secured to the housing and projecting out of the first tube, and a spring disposed between the pushbutton and the housing, and a positioning member for limiting the release mechanism at a first end of the first tube. A pressing of the pushbutton moves the lock needle to insert into the first and second lock mechanism, the first and second lock protuberances depart from the first and second annular groove and urge the first and second elastic members to an unlocked position; without a pressing of the pushbutton, the restored elastic members enable the first and second lock protuberances to return to the first and second annular groove to a locked position.

Preferably, further comprises a first through hole axially disposed through the first lock mechanism and a second through hole axially disposed through the second lock mechanism wherein the lock needle is disposed through each of the first through hole and the second through hole to be locked or clears same to be unlocked.

Preferably, further comprises at least one first O-ring disposed on an outer of the first lock mechanism and at least one second O-ring disposed on an outer of the second lock mechanism.

Preferably, further comprises at least one first wear resistant ring disposed on an inner surface of the first tube.

Preferably, further comprises at least one second wear resistant ring disposed on an inner surface of the third tube.

Preferably, further comprises a plug threadedly secured to a second end of the second tube.

The invention has the following advantages and benefits in comparison with the conventional art: Easy forming. This is because after inner surfaces of both the first inner support tube and the second inner support tube are worn to a predetermined extent, both the first inner support tube and the second inner support tube can be pulled out of the first tube and replaced with new ones. The first annular groove can be formed by forming the internal threads and threadedly securing both the first inner support tube and the second inner support tube to the internal threads sequentially. Wall thickness of the first tube is decreased greatly.

Greatly decreased components replacement cost. This is because the second tube is moveably disposed in the first tube and components are subject to wear and therefore a frequent replacement is required Further, this can greatly decrease the difficulties of manufacturing the first tube. Because the first inner support tube and the second inner support tube are threadedly to inside of the first tube. Thus, only both the first inner support tube and the second inner support tube are required to replace rather than the first tube. In comparison with replacing the first tube, the cost of replacing both the first inner support tube and the second inner support tube is relatively small.

The above and other objects, features and advantages of the invention will become apparent from the following detailed description taken with the accompanying drawings.

DETAILED DESCRIPTION OF THE INVENTION

Figure 1:
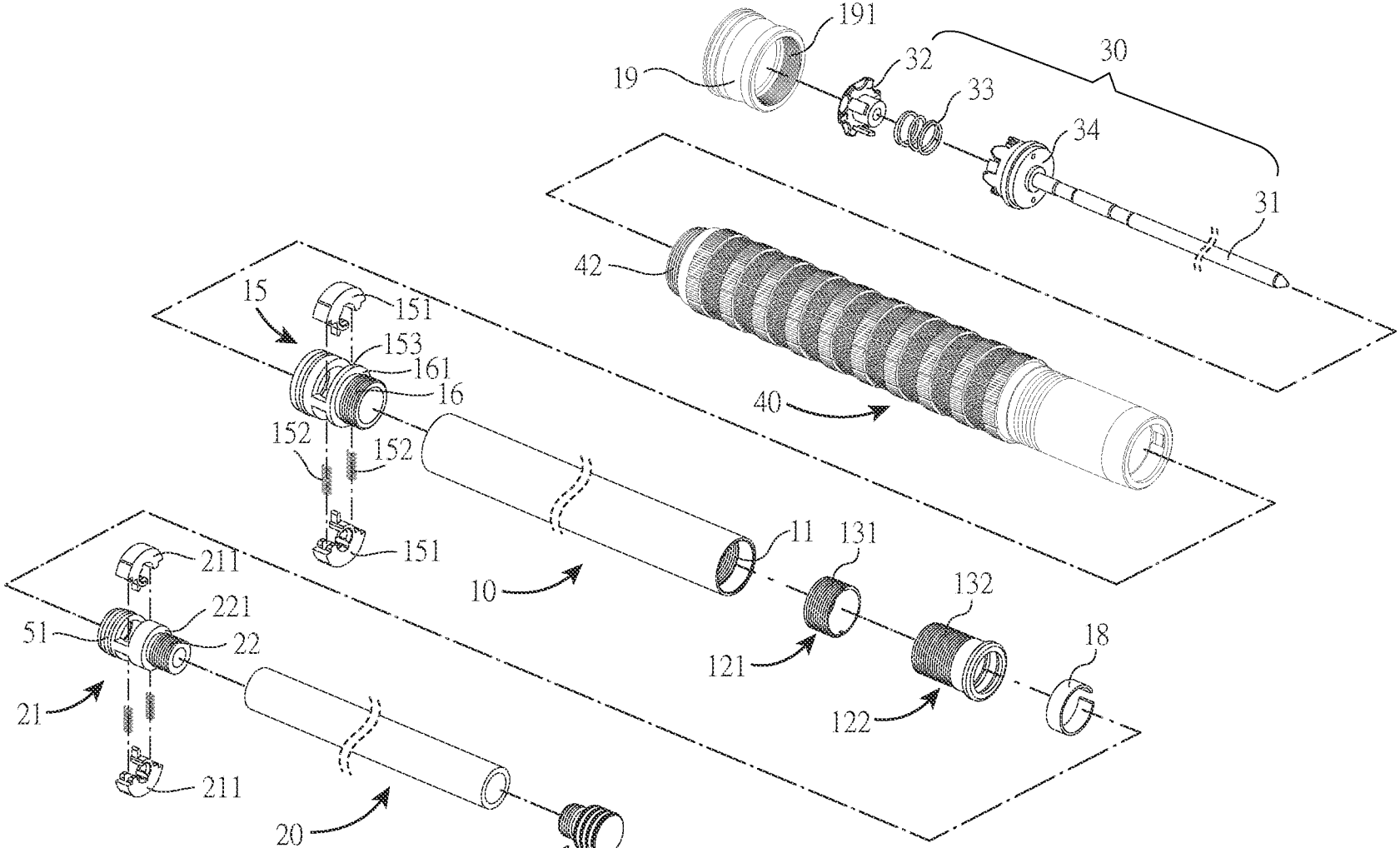
FIG. 1 is an exploded view of an expandable baton according to the invention.
Figure 5:
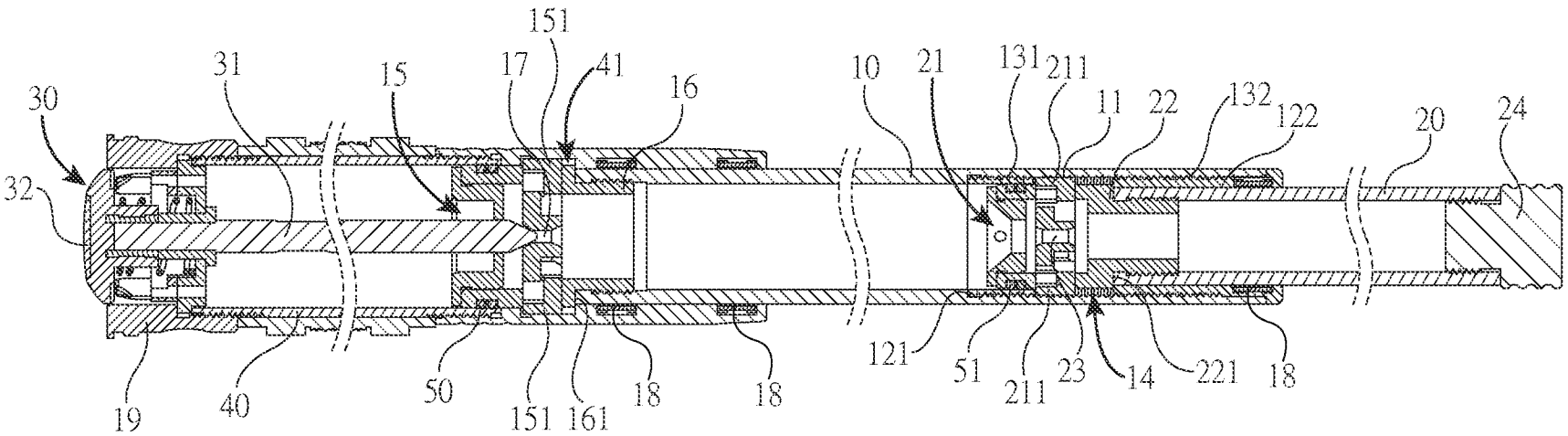
FIG. 5 is a longitudinal sectional view of the assembled expandable baton in an extended position.
Figure 6:
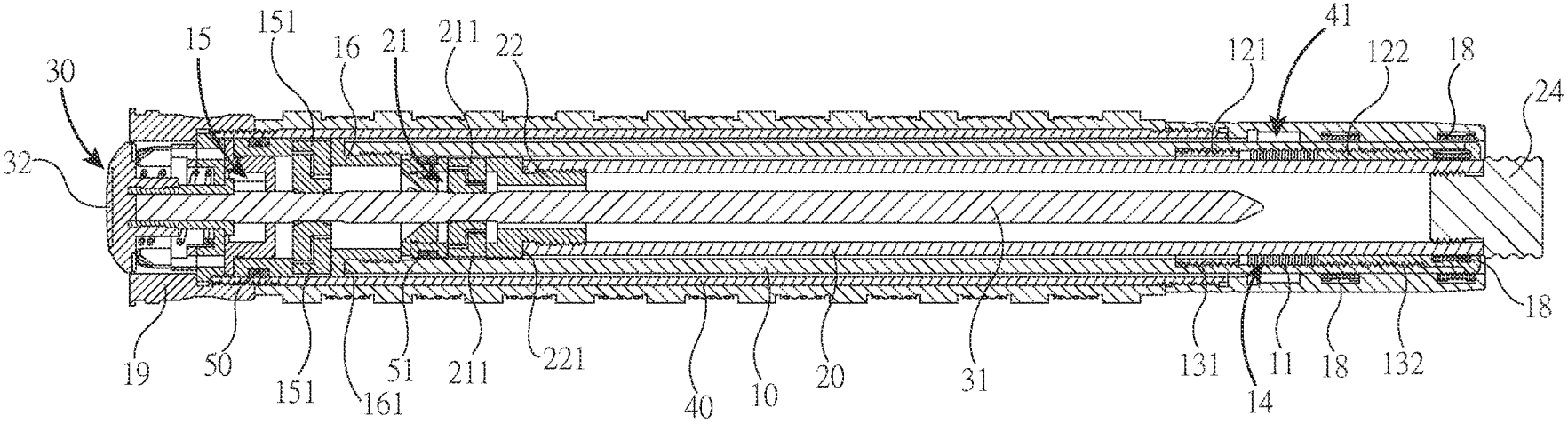
FIG. 6 is a view similar to FIG. 5, the assembled expandable baton being in a retracted position.

Referring to FIGS. 1, 5 and 6, an expandable baton in accordance with the invention comprises a first tube 10, a first inner support tube 121, a second inner support tube 122, a second tube 20, a release mechanism 30 and a positioning member 19 as discussed in detail below. As shown in FIG. 1, the first inner support tube 121 and the second inner support tube 122 are taken as an embodiment. The first tube 10 includes internal threads 11. A diameter of the first inner support tube 121 is less than that of the first tube 10. First external threads 131 are disposed on an outer surface of the first inner support tube 121. The first external threads 131 are secured to the internal threads 11 of the first tube 10. A diameter of the second inner support tube 122 is less than that of the first tube 10. Second external threads 132 are disposed on an outer surface of the second inner support tube 122. The second external threads 132 are secured to the internal threads 11 of the first tube 10. The second inner support tube 122 is spaced from the first inner support tube 121 with a first annular groove 14 formed between them. A first lock mechanism 15 is provided at a first end of the first tube 10 and includes a first locking pipe 153, two first lock protuberances 151, two first elastic members 152 and a first externally threaded connection 16. A second lock mechanism 21 is similar to the first lock mechanism 15, provided at a first end of the second tube 20. Referring to FIG. 1 and in conjunction with FIG. 2, the second lock mechanism 21 includes a second locking pipe 213, two second lock protuberances 211, two second elastic members 212 and a second externally threaded connection 22. The second externally threaded connection 22 includes a second shoulder 221 adjacent to the second lock protuberances 211. An inner diameter of the second inner support tube 122 is less than an outer diameter of the second shoulder 221. The outer diameter of the second shoulder 221 is less than an inner diameter of the first inner support tube 121. The second externally threaded connection 22 is disposed in the first end of the second tube 20 and the second shoulder 221 urges against the first end of the second tube 20. A distance between each of the second lock protuberances 211 and the second shoulder 221 is equal to a length of the first annular groove 14. A plug 24 is threadedly secured to a second end of the second tube 20. The release mechanism 30 includes an axially moveable lock needle 31 having a pointed second end and a housing 34 at a first end. A pushbutton 32 is correspondently secured to the housing 34 and projects out of the first tube 10. A spring 33 is disposed between the pushbutton 32 and the housing 34. A pressing of the pushbutton 32 urges against the spring 33 and moves the lock needle 31. The positioning member 19 includes a fourth internal threads 191 on one end and is threadly secured to a third external threads 42 on a first end of a third tube 40, securing and limiting the release mechanism 30 at the first end of the third tube 40.

Figure 2:
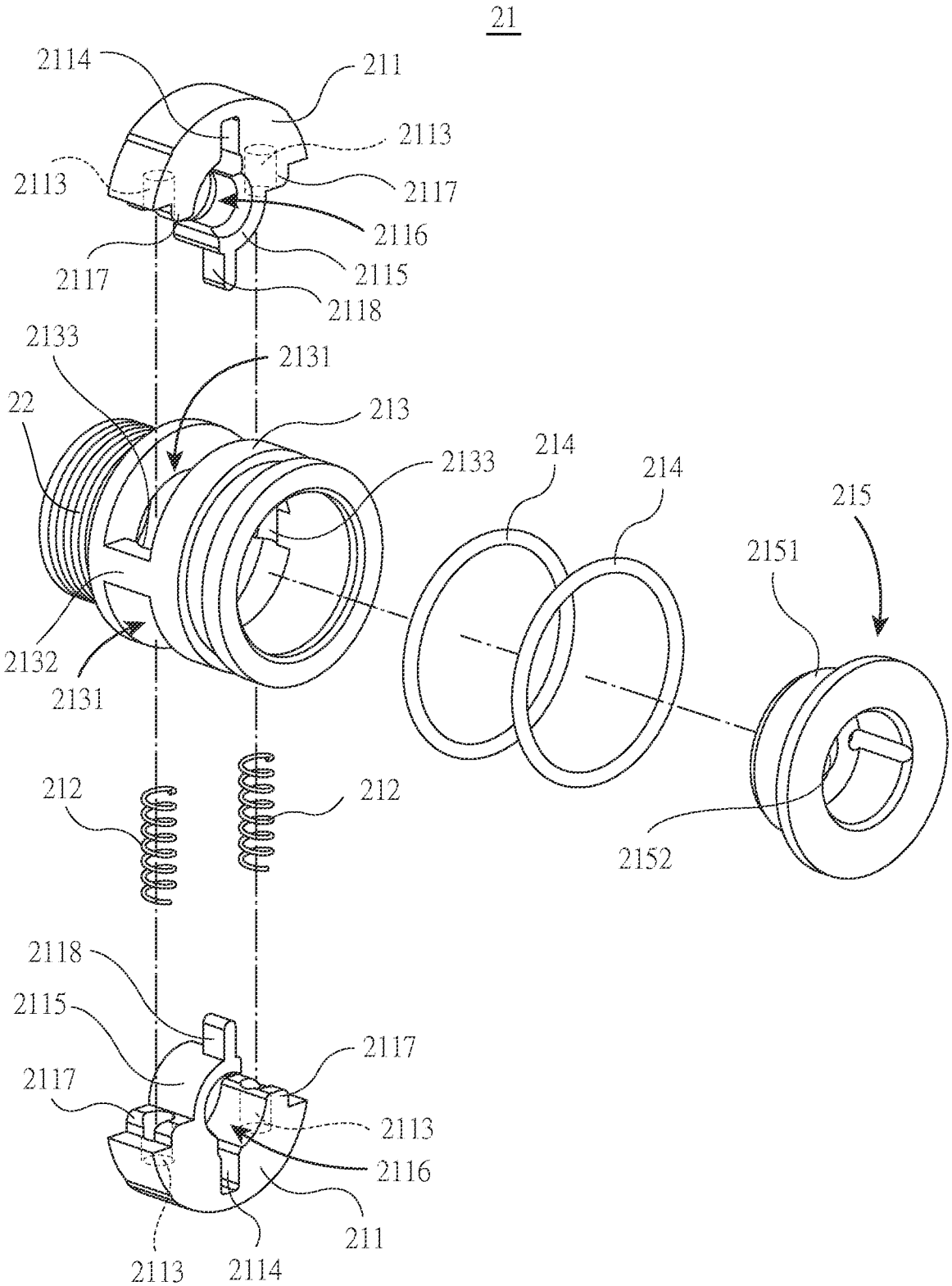
FIG. 2 is an exploded view of a second lock mechanism.

As shown in FIG. 2, an explosive view of the second lock mechanism 21 is shown. The second locking pipe 213 includes two shifting slots 2131 positioned at two opposite walls and provided with a plurality of pillars 2132 paralleled to each other and disposed between the two shifting slots 2131, enabling the two second lock protuberances 211 movably positioned in the two shifting slots 2131. One end of each of the second lock protuberances 211 further includes two hollow seats 2113 positioned symmetrically, each of the hollow seats 2113 is provided with the correspondent second elastic member 212. A concaved slot 2114 is disposed between the two hollow seats 2113. Each of the second lock protuberances 211 is provided with an arch portion 2115 elongated towards an end opposite from the hollow seats 2113 forming an arch slot 2116 on an inner surface. An outer surface of the arch portion 2115 is provided with a protrusion 2118 projecting towards an end opposite from the concaved slot 2114. The protrusion 2118 and the concaved slot 2114 are aligned axially and the protrusion 2118 of one of the second lock protuberances 211 is correspondent to the concaved slot 2114 of the other second lock protuberance 211. The protrusion 2118 of one of the lock protuberances 211 is inserted into the concaved slot 2114 of the other second lock protuberance 211. At least one O-ring (two are shown) 214 is provided on an outer surface of the second locking pipe 213 for the purpose of increasing friction. On an inner surface of each of the pillars 2132 is provided with a trough 2133. Each of the troughs 2133 provides the correspondent second elastic member 212 enough space to extend and retract. Each of the second lock protuberances 211 is provided with at least one extension 2117 extending from a same surface which the hollow seats 2113 are disposed. The extensions 2117 are provided on an outer edge of the second elastic members 212, and can further limit the position of the second elastic members 212. The second locking pipe 213 further comprises a guiding member 215 that is provided with an annular flange 2151 extended from an end of the guiding member 215. The annular flange 2151 is clamped to an end of the second locking pipe 213. A guiding hole 2152 is disposed through the guiding member 215. The guiding hole 2152 provides the lock needle 31 to pass through and guides the lock needle 31 to a correct position. In addition, the guiding hole 2152 is tapered shaped.

Figure 3:
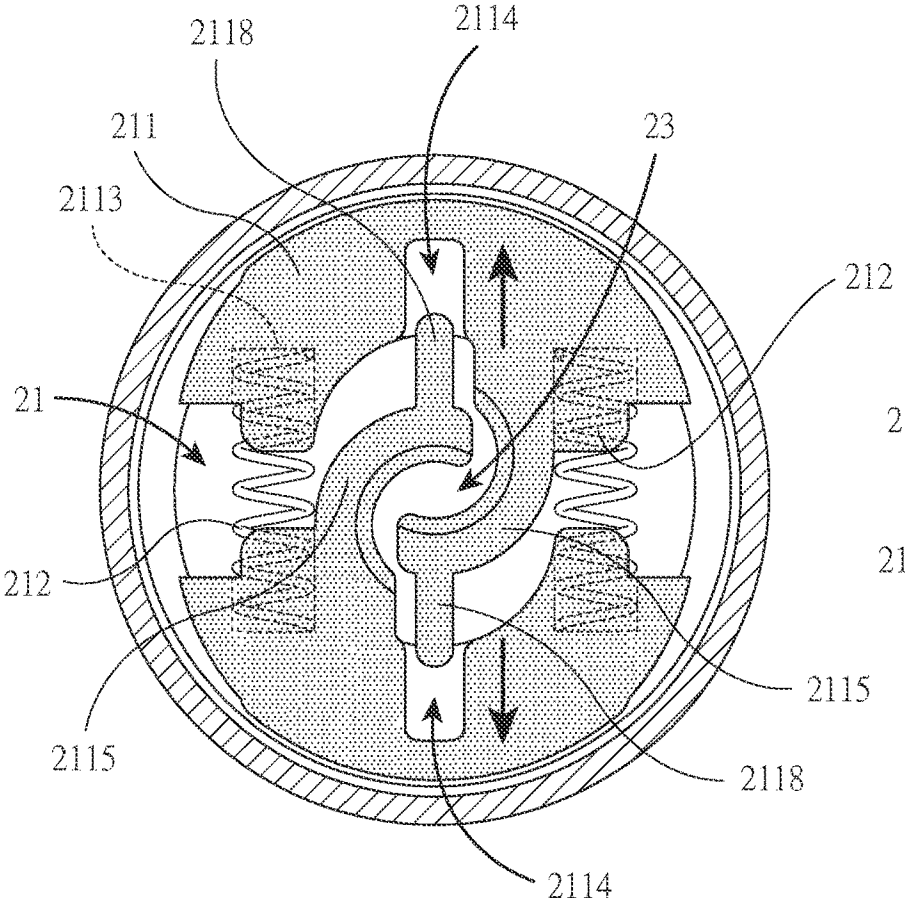
FIG. 3 is a sectional view of the second lock mechanism in a locked position.

Referring to FIGS. 3 and 5, when the second lock mechanism 21 is not pushed by any outer force, the second elastic members 212 urge the second lock protuberances 211 to move away from each other, so the second lock protuberances 211 are clamped to the first annular groove 14. The protrusions 2118 depart from the correspondent concaved slots 2114 with the arch portions 2115 crossed together. As a result, the second lock mechanism 21 is locked and the second tube 20 is clamped to the first tube 10.

Figure 4:
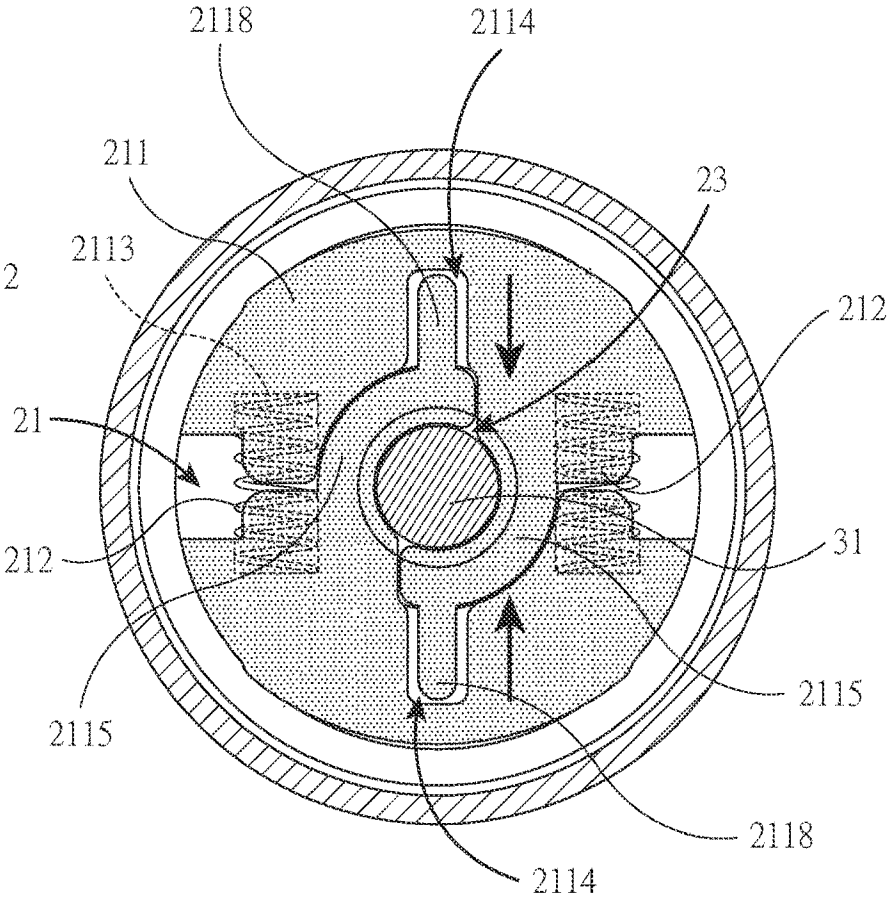
FIG. 4 is a sectional view of the second lock mechanism in an unlocked position.

Referring to FIGS. 2, 4 and 6, the lock needle 31 is inserted into the second lock mechanism 21, due to the tapered shape of the guiding hole 2152, the guiding hole 2152 guides the lock needle 31 to move along the tapered shape and reach the arch portions 2115. While the lock needle 31 is inserted into the arch portions 2115, the correspondent parts of the second lock protuberances 211 are combined, and the arch slot 2116 is provided on an inner surface of the arch portions 2115, forming a second through hole 23. Subsequently, the lock needle 31 pushes the arch portions 2115 simultaneously. The lock needle 31 pushes the arch portions 2115 until passing through. At this time, the second lock protuberances 211 move toward each other and urge the second elastic elements 212. The second lock mechanism 21 departs the first annular groove 14. The second lock mechanism 21 is unlocked. By this way, the second tube 20 passes through the first tube 10.

The second lock protuberances 211 of the second lock mechanism 21 are clamped to or departed from the first annular groove 14. Thus, the second lock mechanism 21 is moveably secured to the first annular groove 14. The second tube 20 is moveably disposed in the first tube 10.

Referring to FIG. 1 again and in conjunction with FIG. 5, the first externally threaded connection 16 includes a first shoulder 161 adjacent to the first lock protuberances 151. The first externally threaded connection 16 is disposed in the first end of the first tube 10 and the first shoulder 161 urges against the first end of the first tube 10. The first tube 10 is moveably disposed in the third tube 40. A second annular groove 41 is formed on an inner surface of the third tube 40. A distance between each of the first lock protuberances 151 and the first shoulder 161 is equal to a length of the second annular groove 41. The first lock mechanism 15 is moveably secured to the second annular groove 41. A first through hole 17 is axially provided through the first lock mechanism 15 and the second through hole 23 is axially provided through the second lock mechanism 21 respectively. The lock needle 31 may dispose through each of the first through hole 17 and the second through hole 23 to be locked or clear same to be unlocked. A t least one O-ring (two are shown) 50 is provided on an outer of the first lock mechanism 15 and at least one O-ring (two are shown) 51 is provided on an outer of the second lock mechanism 21 both for the purpose of increasing friction. Further, at least one wear resistant ring (one is shown) 18 is provided on an inner surface of each of the first tube 10 and the third tube 40 for the purpose of adding resistance to each of the first tube 10 and the third tube 40.

As shown in FIG. 5 specifically, it is a longitudinal sectional view of the assembled expandable baton in an extended position. After the assembled baton has been extended, the second lock protuberances 211 are clamped to the first annular groove 14, so the second lock mechanism 21 is fastened at the first annular groove 14, i.e., the second tube 20 being attached to the second end of the first tube 10. As a result, the extended baton is fastened. For further expanding the baton, the third tube 40 can be attached to the first end of the first tube 10 rather than the second end of the tube 10 which is attached to the second tube 20. With the first lock protuberances 151 clamped to the second annular groove 41, the first lock mechanism 15 fastened at the second annular groove 41, the third tube 40 is attached to the first end of the first tube 10. At this time, the release mechanism 30 is disposed at the first end of the third tube 40 (i.e., opposite to the first end of the first tube 10) with the lock needle 31 not passed through the first through hole 17. As a result, both the first lock mechanism 15 and the second lock mechanism 21 are locked.

As shown in FIG. 6 in conjunction with FIG. 5 specifically in which FIG. 6 is a longitudinal sectional view of the assembled expandable baton in a retracted position. The lock needle 31 of the release mechanism 30 passes through the first through hole 17 and the second through hole 23 sequentially to unlock both the first lock mechanism 15 and the second lock mechanism 21. Thus, the first lock mechanism 15 clears the second annular groove 41, the second lock mechanism 21 clears the first annular groove 14, the second tube 20 is retracted into the first tube 10, and the first tube 10 is retracted into the third tube 40 respectively. As an end, the expandable baton is retracted.

Figure 7:
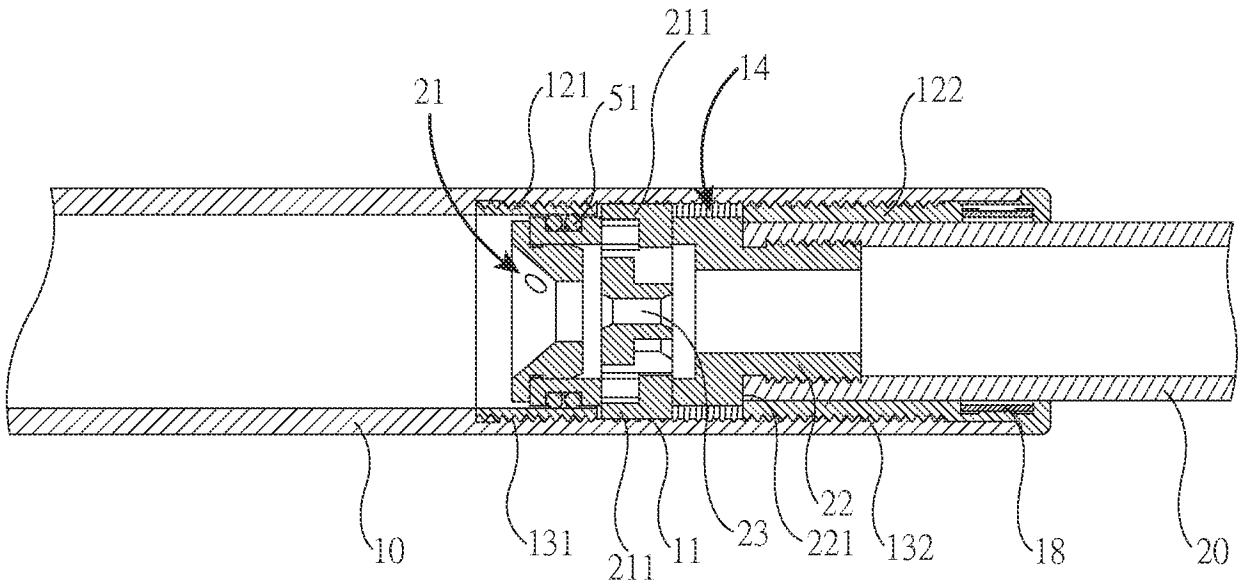
FIG. 7 is an enlarged view of the central, right portion of FIG. 5 showing the second tube partially extended out of the first tube.

Referring to FIG. 7, it is an enlarged view of the central, right portion of FIG. 5 showing the second tube 20 partially extended out of the first tube 10. The elongated internal threads 11 are formed on the inner surface of the first tube 10 with both the first inner support tube 121 and the second inner support tube 122 threadedly fastened therein. A total length of the first inner support tube 121 and the second inner support tube 122 is less than a length of the internal threads 11. Thus, the first annular groove 14 is formed among the first inner support tube 121, the second inner support tube 122 and the internal threads 11. The second lock mechanism 21 is locked by the first annular groove 14. As a result, the second tube 20 is attached to a predetermined position in the first tube 10.

Figure 8:
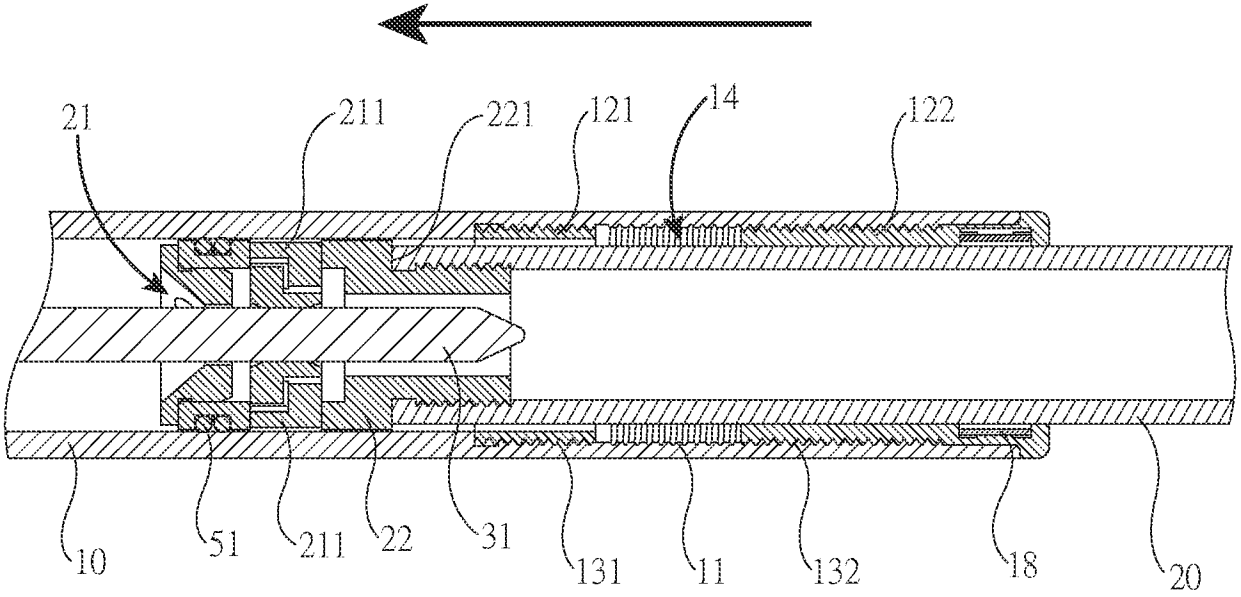
FIG. 8 is a view similar to FIG. 7 showing the second tube partially retracted into the first tube.
Figure 9:
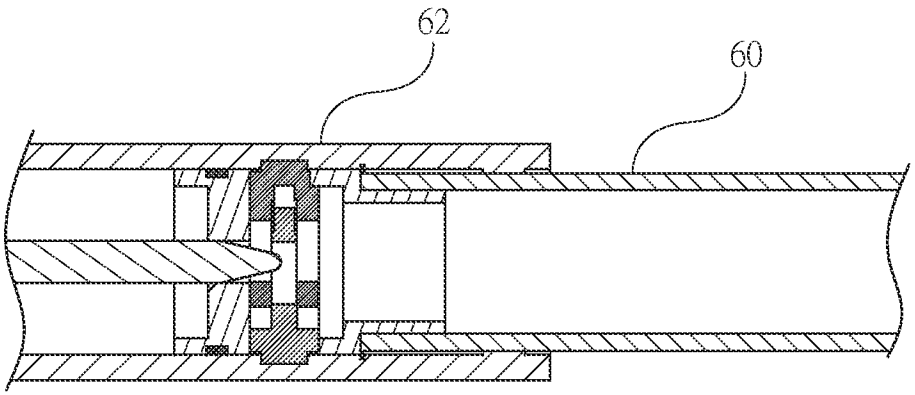
Prior Art FIG. 9
FIG. 9 is a longitudinal sectional view showing a smaller tube secured to a larger tube by snapping according to the conventional art.
Figure 10:
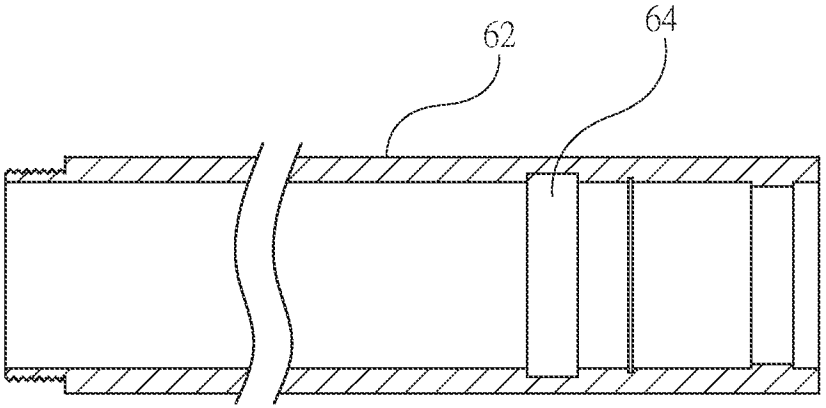
Prior Art FIG. 10
FIG. 10 is a longitudinal sectional view of the larger tube according to the conventional art.

Referring to FIG. 8, it is an enlarged view of the central, right portion of FIG. 6 showing the second tube 20 partially retracted into the first tube 10. As indicated by arrow, the lock needle 31 passes through the second lock mechanism 21 to cause the second lock mechanism 21 to clear the first annular groove 14. As a result, the second tube 20 is moveably disposed in the first tube 10.

The invention has the following advantages and benefits in comparison with the conventional art: After inner surfaces of both the first inner support tube 121 and the second inner support tube 122 are worn to a predetermined extent, both the first inner support tube 121 and the second inner support tube 122 can be pulled out of the first tube 10 by rotation and replaced with new ones. Thus, only both the first inner support tube 121 and the second inner support tube 122 are replaced rather than the first tube 10. This can greatly decrease the components replacement cost. Further, this can greatly decrease the difficulties of manufacturing the first tube 10. The first annular groove 14 can be formed by forming the internal threads 11 and threadedly securing both the first inner support tube 121 and the second inner support tube 122 to the internal threads 11 sequentially.

While the invention has been described in terms of preferred embodiments, those skilled in the art will recognize that the invention can be practiced with modifications within the spirit and scope of the appended claims.

What is claimed is:

1. An expandable baton, comprising:

a first tube including internal threads on an inner surface of a second end;

a first inner support tube having a diameter less than that of the first tube, the first inner support tube including first external threads on an outer surface, the first external threads being secured to the internal threads of the first tube;

a second inner support tube having a diameter less than that of the first tube, the second inner support tube including second external threads on an outer surface, the second external threads being secured to the internal threads of the first tube, the second inner support tube spaced from the first inner support tube with a first annular groove formed between them;

a second tube having a diameter less than an inner diameter of the second inner support tube;

a second lock mechanism disposed at a first end of the second tube and including two second lock protuberances, two second elastic members and a second externally threaded connection wherein the second externally threaded connection includes a second shoulder adjacent to the second lock protuberances, the inner diameter of the second inner support tube is less than an outer diameter of the second shoulder, the outer diameter of the second shoulder is less than an inner diameter of the first inner support tube, the second externally threaded connection is disposed in the first end of the second tube and the second shoulder urges against the first end of the second tube, a distance between each of the second lock protuberances and the second shoulder is equal to a length of the first annular groove, the second lock mechanism is moveably secured to the first annular groove, and the second tube is moveably disposed in the first tube;

a first lock mechanism at the first end of the first tube, the first lock mechanism including two first lock protuberances, two first elastic members and a first externally threaded connection, the first externally threaded connection including a first shoulder adjacent to the first lock protuberances, the first externally threaded connection being disposed in the first end of the first tube and the first shoulder urges against the first end of the first tube, and the first tube being moveably disposed in a third tube; and a second annular groove formed on an inner surface of the third tube wherein a distance between each of the first lock protuberances and the first shoulder is equal to a length of the second annular groove, and the first lock mechanism is moveably secured to the second annular groove;

a release mechanism including an axially moveable lock needle having a pointed second end and a housing at a first end, a pushbutton correspondently secured to the housing and projecting out of the first tube, and a spring disposed between the pushbutton and the housing; and a positioning member secured to the third tube for limiting the release mechanism at a first end of the third tube;

a pressing of the pushbutton moves the lock needle to insert into the first and second lock mechanism, the first and second lock protuberances depart from the first and second annular groove and urge the first and second elastic members to an unlocked position;

without a pressing of the pushbutton, the restored elastic members enable the first and second lock protuberances to return to the first and second annular groove to a locked position.

2. The expandable baton of claim 1, further comprising a first through hole axially disposed through the first lock mechanism and a second through hole axially disposed through the second lock mechanism wherein the lock needle is disposed through each of the first through hole and the second through hole to be locked or clears same to be unlocked.

3. The expandable baton of claim 1, further comprising at least one first O-ring disposed on an outer of the first lock mechanism and at least one second O-ring disposed on an outer of the second lock mechanism.

4. The expandable baton of claim 1, further comprising at least one first wear resistant ring disposed on an inner surface of the first tube.

5. The expandable baton of claim 1, further comprising at least one second wear resistant ring disposed on an inner surface of the third tube.

6. The expandable baton of claim 1, further comprising a plug threadedly secured to a second end of the second tube.

* * * * *